United States Patent [19]

Cheung

[11] Patent Number: 4,902,321

[45] Date of Patent: Feb. 20, 1990

[54] CRYOGENIC RECTIFICATION PROCESS FOR PRODUCING ULTRA HIGH PURITY NITROGEN

[75] Inventor: Harry Cheung, Buffalo, N.Y.

[73] Assignee: Union Carbide Corporation, Danbury, Conn.

[21] Appl. No.: 324,444

[22] Filed: Mar. 16, 1989

[51] Int. Cl.[4] ..... F25J 3/02

[52] U.S. Cl. ..... 62/24; 62/34

[58] Field of Search ..... 62/11, 23, 24, 34, 32

[56] References Cited

U.S. PATENT DOCUMENTS

| | | | |
|---|---|---|---|
| 3,210,947 | 10/1965 | Dubs et al. | 62/13 |
| 4,416,677 | 11/1983 | Pahade | 62/24 |
| 4,526,595 | 7/1985 | McNeil | 62/34 |
| 4,566,887 | 1/1986 | Openshaw | 62/21 |
| 4,594,085 | 6/1986 | Cheung | 62/34 |
| 4,617,037 | 10/1986 | Okada et al. | 62/11 |
| 4,617,040 | 10/1986 | Yoshino | 62/37 |
| 4,755,202 | 7/1988 | Cheung | 62/34 |

*Primary Examiner*—Ronald C. Capossela

*Attorney, Agent, or Firm*—Stanley Ktorides

[57] ABSTRACT

A process for producing ultra high purity nitrogen from nitrogen produced by the cryogenic rectification of air wherein superatomospheric nitrogen is progressively condensed and revaporized to effect rejection of lower boiling impurities without need for additional energy beyond that contained in the nitrogen input.

11 Claims, 2 Drawing Sheets

CRYOGENIC RECTIFICATION PROCESS FOR PRODUCING ULTRA HIGH PURITY NITROGEN

TECHNICAL FIELD

This invention relates generally to air separation by cryogenic rectification and more particularly to the production of ultra high purity nitrogen.

BACKGROUND ART

The separation of air into its major components by cryogenic rectification is a well established commercial process. Nitrogen is produced at very high purity using this process wherein the components of air are separated based on their relative volatilities. Of the major components of air, nitrogen is the more volatile and thus lower boiling impurities such as helium, hydrogen and neon concentrate in the nitrogen product. The concentration of these lower boiling impurities in the nitrogen product from a cryogenic air separation plant generally does not exceed 100 ppm and thus is not a problem for most uses of the nitrogen. However some nitrogen applications, such as in the electronics industry, require nitrogen of ultra high purity wherein the concentration of lower boiling impurities is much lower than is possible with conventional air separation.

Accordingly it is an object of this invention to provide a cryogenic rectification air separation process which can produce nitrogen of ultra high purity wherein the concentration of lower boiling impurities is much lower than is possible with conventional air separation.

SUMMARY OF THE INVENTION

The above and other objects which will become apparent to one skilled in the art upon a reading of this disclosure are attained by the present invention which is:

Process for producing ultra high purity nitrogen comprising:

(a) introducing compressed feed air into a cryogenic rectification zone;

(b) separating the compressed feed air by cryogenic rectification to produce higher pressure nitrogen-rich vapor containing lower boiling impurities;

(c) partially condensing the nitrogen-rich vapor to produce nitrogen-richer liquid and vapor enriched with lower boiling impurities;

(d) expanding the nitrogen-richer liquid to produce lower pressure nitrogen-richer fluid;

(e) passing the resulting lower-pressure nitrogen-richer fluid in indirect heat exchange with the nitrogen-rich vapor to carry out the partial condensation of step (c) and to produce nitrogen-richer vapor; and (f) recovering nitrogen-richer vapor as ultra high purity nitrogen product.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H Chilton, McGraw-Hill Book Company, New York, Section 13, "Distillation" B. D. Smith, et al., page 13-3 *The Continuous Distillation Process.* The term, double column, is used herein to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

The term "stripping column" as used herein means a column operated with sufficient vapor upflow relative to liquid downflow to achieve separation of a volatile component from the liquid into the vapor.

The term "indirect heat exchange", as used herein means the bringing of two fluid streams into heat exchange relation without any physical contact or intermixing of the fluids with each other.

As used herein, the term "lower boiling impurity" means an element or compound having a lower boiling point than nitrogen.

DETAILED DESCRIPTION

The process of this invention will be described in detail with reference to the Drawings. The process of the invention may be carried out with any cryogenic rectification air separation process such as the conventional single column and double column processes which are well known to those skilled in the art. The Drawings illustrate the process of the invention carried out with a single column cryogenic rectification process.

Figure 1:
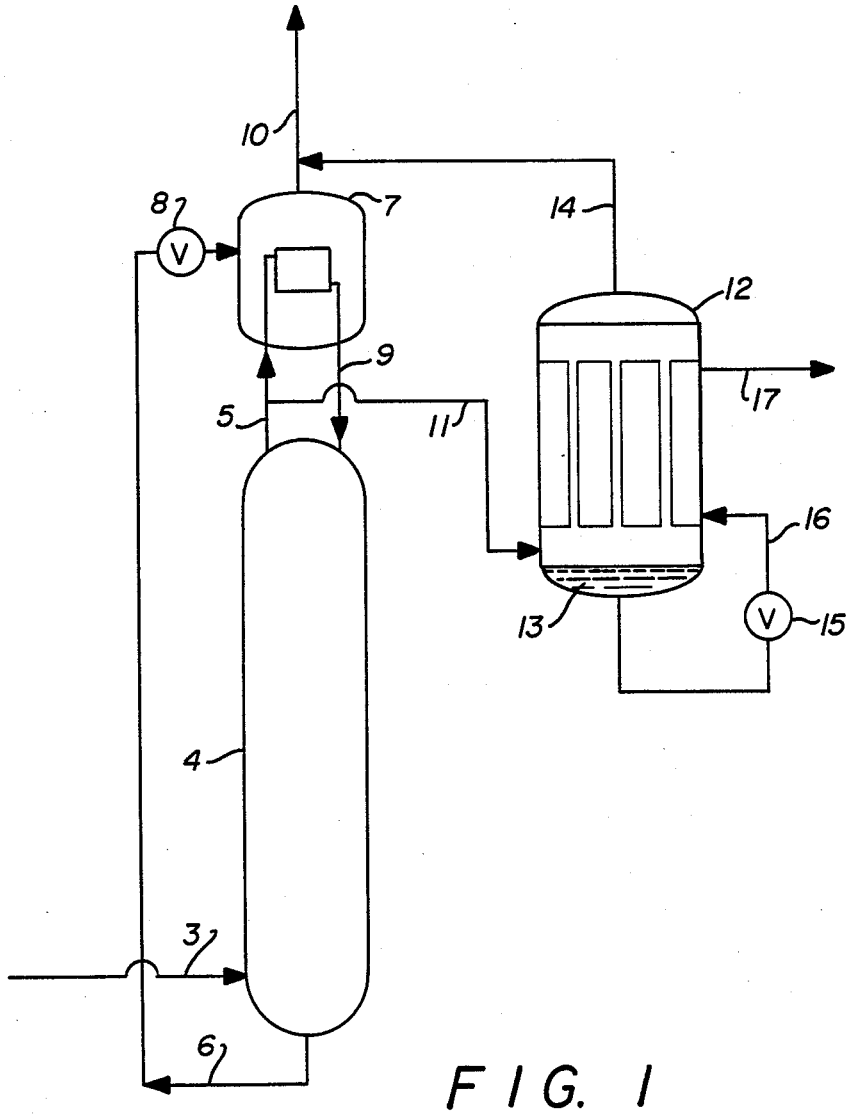
FIG. 1 is a schematic flow diagram of one embodiment of the process of this invention wherein a reflux condenser is employed.

Referring now to FIG. 1, feed air 3, which has been cooled and cleaned of high boiling impurities such as water and carbon dioxide and has been compressed to a pressure within the range of from 65 to 155 pounds per square inch absolute (psia) is introduced into a cryogenic rectification plant, in this case into a single column plant operating at a pressure within the range of from 50 to 150 psia. Within column 4 the feed air is separated into nitrogen-rich vapor 5 and oxygen-enriched liquid 6. Nitrogen-enriched vapor 5 is passed into top condenser 7 wherein it is condensed by indirect heat exchange with oxygen-enriched liquid which is supplied into top condenser 7 after a pressure reduction through valve 8. Resulting nitrogen-rich liquid 9 is return to column 4 as reflux while waste stream 10 is removed from top condenser 7.

Nitrogen-rich vapor 5 will contain essentially all of the lower boiling impurities, such a helium, hydrogen and neon, which were in feed air 3. This is because in a cryogenic rectification process wherein the lowest boiling component taken off is nitrogen, the lower boiling impurities can go nowhere but with the nitrogen. The present invention provides a method compatible with cryogenic rectification, to remove these lower boiling impurities from the nitrogen without need for combustion or other catalytic removal methods which have the potential for introducing other impurities to the nitrogen.

Referring back now to FIG. 1, nitrogen-rich vapor stream 11, at an elevated pressure essentially the same as that at which column 4 is operating, and containing at least about 25 ppm lower boiling impurities, is passed into the tube side of shell and tube heat exchanger 12 which acts as a reflux condenser. In the practice of this invention, any heat exchange device in which indirect heat exchange can be carried out may be so employed. A shell and tube heat exchanger such as heat exchanger 12 is one preferred type of heat exchanger. Nitrogen rich vapor 11 rises within heat exchanger 12 and is progressively partially condensed to produce nitrogen-richer liquid 13, which falls and collects at the bottom of heat exchanger 12, and vapor 14 enriched with the lower boiling impurities which is removed from the process. At least about 50 percent of vapor 11 is condensed to form liquid 13.

Nitrogen-richer liquid 13 is expanded through valve 15 to a pressure within the range of from 15 to 125 psia and the resulting lower pressure fluid 16 is introduced into the shell side of heat exchanger 12. The expansion through valve 15 may cause some of the nitrogen-richer liquid to flash and thus fluid 16 may have both liquid and vapor phases. The pressure difference between streams 11 and 16 will generally be at least 5 psi and may be up to 100 psi. This pressure difference causes heat to flow from fluid 11 to fluid 16 within heat exchanger 12. This indirect heat exchange causes the progressive partial condensation of nitrogen-rich vapor 11 discussed above, and also causes nitrogen-richer fluid 16 to be vaporized. In general the temperature difference across condenser/revaporizer 12 is less than 10° K., preferably less than 5° K. and most preferably within the range of from 0.5° K. to 2° K. The resulting nitrogen-richer vapor 17 is removed from heat exchanger 12 and recovered as ultra high purity nitrogen product having a concentration of lower boiling impurities which does not exceed about 5 ppm.

As can be seen, the process of this invention is compatible with a cryogenic rectification air separation plant in that, after start-up, no additional energy need be supplied to carry out the added purification beyond that supplied by the nitrogen-rich vapor from the air separation plant.

Figure 2:
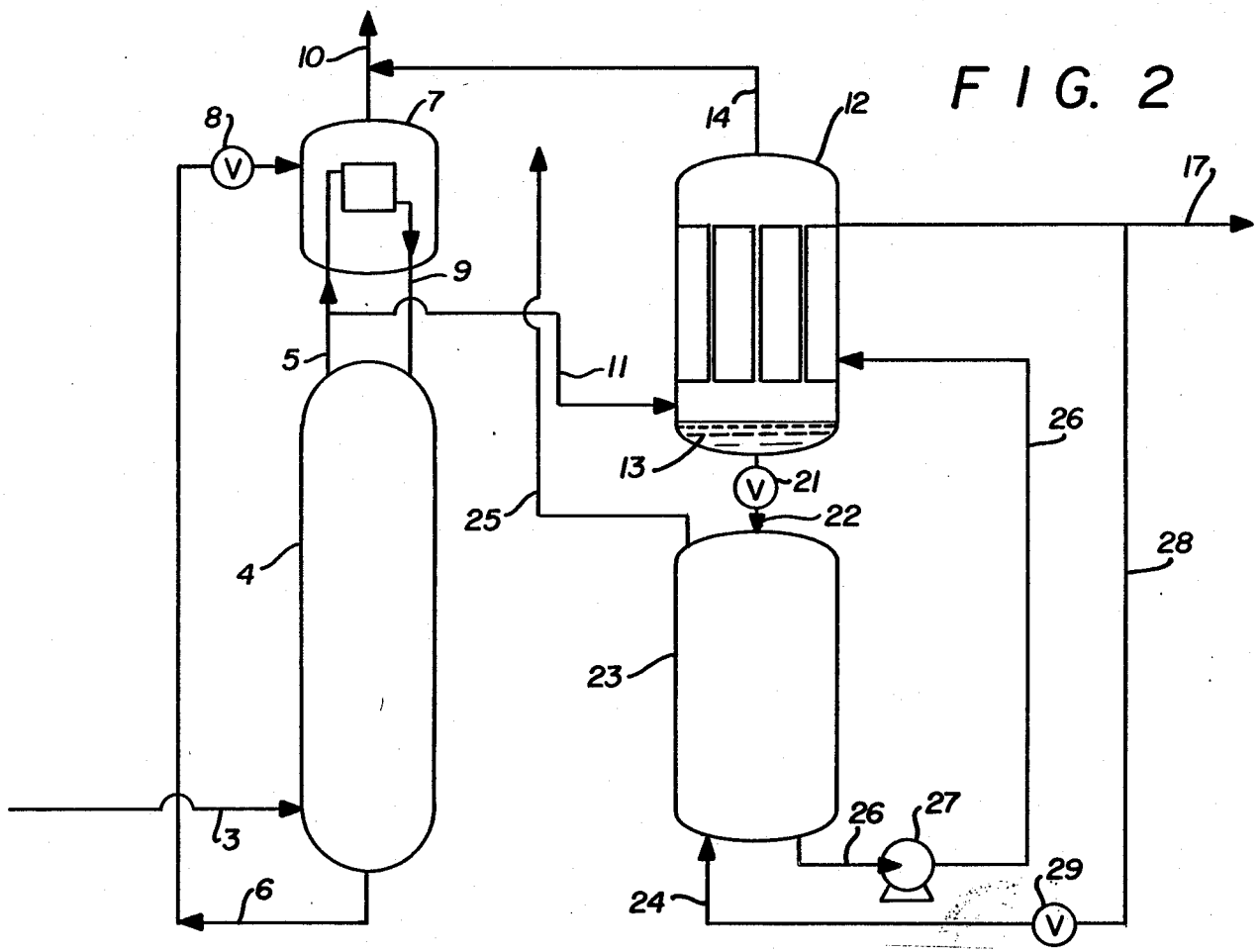
FIG. 2 is a schematic flow diagram of another embodiment of the process of this invention wherein a reflux condenser and stripping column are employed.

FIG. 2 illustrates another embodiment of the invention wherein a stripping column is employed in addition to the reflux condenser. The elements of the embodiment illustrated in FIG. 2 which are identical to those of the embodiment illustrated in FIG. 1 bear the same numerals and will not be again described. The additional stripping column is advantageous for the attainment of the highest purity ultra high purity nitrogen as well as for process flexibility with respect to stripping pressure.

Referring now to FIG. 2, nitrogen-richer liquid 13 is expanded through valve 21 to a pressure within the range of from 15 to 125 psia and the resulting lower pressure fluid 22 is passed into and down stripping column 23. The expansion through valve 21 may cause some of the nitrogen-richer liquid to flash and thus fluid 22 may have both liquid and vapor phases.

Vapor 24 is passed into and up stripping column 23 in countercurrent flow to downflowing fluid 22. During this countercurrent flow, lower boiling impurities are stripped from the downflowing fluid into the upflowing vapor. The vapor, containing the stripped lower boiling impurities, is removed from stripping column 23 as stream 25.

The resulting cleaner nitrogen-richer fluid is removed from stripping column 23 as stream 26 and is passed into the shell side of heat exchanger 12. Depending on the pressure at which stripping column 23 is operating, it may be desirable to pump stream 26 to a higher pressure such as by pump 27 prior to passing stream 26 into heat exchanger 12. If the pressure of stream 26 is increased, it must not be increased to the point where it equals or exceeds the pressure of the nitrogen-rich vapor 11. The pressure difference between streams 11 and 26 will generally be at least 5 psi and may be up to 100 psi. This pressure difference causes heat to flow from fluid 11 to fluid 26 within heat exchanger 12. This indirect heat exchange causes progressive partial condensation of nitrogen-rich vapor 11, and also causes nitrogen-richer fluid 26 to be vaporized. In general the temperature difference across condenser/revaporizer 12 is less than 10° K., preferably less than 5° K. and most preferably within the range of from 0.5° K. to 2° K. The resulting nitrogen-richer vapor 17 is removed from heat exchanger 12 and recovered as ultra high purity nitrogen product having a concentration of lower boiling impurities which does not exceed about 1 ppm.

Vapor 24 may be taken from any suitable source. FIG. 2 illustrates a particularly preferred source wherein some of vapor 17 is employed as vapor 24. In this case a portion 28 of stream 17 is expanded through valve 29 to form vapor 24 for passage into stripping column 23. Generally stripping column 23 will be operating at a pressure within the range of from 15 to 125 psia.

In Table 1 there is presented data of an example of this invention taken from a calculated simulation of the process of the invention carried out in accord with the embodiment illustrated in FIG. 2. The example is presented for illustrative purposes and is not intended to be limiting. The stream numbers in Table 1 correspond to those of FIG. 2.

TABLE 1

| Stream Number | Temp. (°K.) | Pressure (psia) | Flowrate (CFH) | Concentration Neon | Hydrogen | Helium |
|---|---|---|---|---|---|---|
| 11 | 101.8 | 128.7 | 100 | 45 ppm | 2 ppm | 5 ppm |
| 13 | 101.8 | 128.7 | 99 | 1.5 ppm | 0.07 ppm | <0.01 ppm |
| 14 | 101.8 | 128.7 | 1 | 4352 ppm | 194 ppm | 499 ppm |
| 17 | 100.8 | 120.0 | 84 | 1 ppb | 0.07 ppb | <0.001 ppb |
| 22 | 94.0 | 72.5 | 99 | 1.5 ppm | 0.07 ppm | <0.01 ppm |
| 24 | 95.3 | 72.5 | 5 | 1 ppb | 0.07 ppb | <0.001 ppb |
| 25 | 94.0 | 72.5 | 15 | 9.9 ppm | 0.46 ppm | 0.07 ppm |
| 26 | 94.0 | 72.5 | 89 | 1 ppb | 0.07 ppb | <0.001 ppb |
| 28 | 100.8 | 120.0 | 5 | 1 ppb | 0.07 ppb | <0.001 ppb |

Now by the use of the process of this invention one can produce ultra high purity nitrogen having reduced lower-boiling impurities compatibly with cryogenic rectification air separation. Although the process of this invention has been described with reference to certain embodiments, those skilled in the art will recoqnize that there are other embodiments within the scope and spirit of the claims. For example, one may optionally desire to recover some of the nitrogen-richer liquid prior to the vaporization in the condenser/revaporizer. In this optional embodiment, preferably some nitrogen-rich liquid 9 is passed into the tube side of the condenser/-revaporizer.

I claim:

1. Process for producing ultra high purity nitrogen comprising.

(a) introducing compressed feed air into a cryogenic rectification zone;

(b) separating the compressed feed air by cryogenic rectification to produce higher pressure nitrogen-rich vapor containing lower boiling impurities;

(c) partially condensing nitrogen-rich vapor to produce nitrogen-richer liquid and vapor enriched with lower boiling impurities;

(d) expanding the nitrogen-richer liquid to produce lower pressure nitrogen-richer fluid;

(e) passing the resulting lower pressure nitrogen-richer fluid in indirect heat exchange with the nitrogen-rich vapor to carry out the partial condensation of step (c) and to produce nitrogen-richer vapor; and (f) recovering nitrogen-richer vapor a ultra high purity nitrogen product.

2. The process of claim 1 wherein the cryogenic rectification is carried out in a single column air separation plant.

3. The process of claim 1 wherein the expansion of step (d) causes the resulting lower pressure fluid to have a pressure at least 5 psi less than the pressure of the higher pressure nitrogen-rich vapor.

4. The process of claim 1 wherein the concentration of lower boiling impurities in the ultra high purity nitrogen product does not exceed 5 ppm.

5. The process of claim 1 wherein at least 50 percent of the nitrogen-richer vapor is condensed in step (c).

6. The process of claim 1 wherein the concentration of lower boiling impurities in the nitrogen-rich vapor is at least 25 ppm.

7. The process of claim 1 further comprising recovering some nitrogen-richer liquid as ultra high purity nitrogen liquid product.

8. The process of claim 1 further comprising passinq lower pressure nitrogen-richer fluid from step (d) in countercurrent flow with vapor to strip lower boiling impurities from the nitrogen-richer fluid into the vapor prior to carrying out step (e).

9. The process of claim 8 further comprising pumping the cleaner nitrogen-richer fluid to a higher pressure but at least 5 psi less than that of the nitrogen-rich vapor prior to carrying out step (e).

10. The process of claim 8 wherein the vapor for countercurrent flow with the lower pressure nitrogen-richer fluid is nitrogen-richer vapor.

11. The process of claim 8 wherein the concentration of lower boiling impurities in the ultra high purity nitrogen product does not exceed 1 ppm.

* * * * *